US005567196A

United States Patent [19]

Theurer

[11] Patent Number: 5,567,196

[45] Date of Patent: Oct. 22, 1996

[54] RAIL GRINDING MACHINE

[75] Inventor: Josef Theurer, Vienna, Austria

[73] Assignee: Franz Plasser Bahnbaumaschinen-Industriegesellschaft m.b.H, Vienna, Austria

[21] Appl. No.: 316,569

[22] Filed: Sep. 30, 1994

[30] Foreign Application Priority Data

Oct. 18, 1993 [AT] Austria ..... 2083/93

[51] Int. Cl.[6] ..... B24B 23/00; B24B 27/08

[52] U.S. Cl. ..... 451/347; 451/429

[58] Field of Search ..... 451/296, 297, 451/301, 302, 303, 168, 176, 172, 336, 347, 429

[56] References Cited

U.S. PATENT DOCUMENTS

| | | | |
|---|---|---|---|
| 4,249,346 | 2/1981 | Theurer et al. . | |
| 4,768,312 | 9/1988 | Williams | 451/347 |
| 4,858,265 | 8/1989 | Suzuki et al. | 451/296 |
| 4,896,460 | 1/1990 | Theurer et al. . | |
| 5,209,027 | 5/1993 | Ishida et al. | 451/303 |

FOREIGN PATENT DOCUMENTS

| | | | |
|---|---|---|---|
| 221131 | 10/1961 | Austria . | |
| 3840006 | 7/1990 | Germany . | |
| 0670667 | 6/1989 | Switzerland | 451/347 |

*Primary Examiner*—D. S. Meislin
*Assistant Examiner*—Derris Banks
*Attorney, Agent, or Firm*—Collard & Roe, P.C.

[57] ABSTRACT

A mobile rail grinding machine comprises a machine frame extending in a longitudinal direction, and undercarriages supporting the machine frame on the track rails for movement in an operating direction. A mounting frame is supported on the track rails by flanged wheels, and a drive vertically adjustably connects the mounting frame to the machine frame. At least one rail head grinding unit is arranged on the mounting frame and comprises an abrasive belt having opposite ends, a storage spool holding one of the belt ends and a collecting spool holding the opposite belt end whereby the abrasive belt may be reeled off the storage spool and onto the collecting spool, and a pressure element arranged to press the abrasive belt against the surface area of the rail head off which the irregularities are to be ground. The grinding unit is positioned adjustably horizontally and in the longitudinal direction, and a driving mechanism imparts an oscillating motion to the grinding unit, which motion is superimposed on the movement of the machine frame in the operating direction.

10 Claims, 2 Drawing Sheets

RAIL GRINDING MACHINE

BACKGROUND OF THE INVENTION

1. Field of the Invention

The present invention relates to a mobile rail grinding machine for grinding irregularities off a surface area of a rail head of track rails, the rail head having side faces and rounded edges connecting the side faces to the surface area. The machine comprises a machine frame extending in a longitudinal direction, undercarriages supporting the machine frame on the track rails for movement in an operating direction, a mounting frame supported on the track rails by flanged wheels, and a drive vertically adjustably connecting the mounting frame to the machine frame. At least one rail head grinding unit on the mounting frame comprises an abrasive belt having opposite ends, a storage spool holding one of the belt ends and a collecting spool holding the opposite belt end whereby the abrasive belt may be reeled off the storage spool and onto the collecting spool, and a pressure element arranged to press the abrasive belt against the surface area of the rail head off which the irregularities are to be ground.

2. Description of the Prior Art

A mobile rail grinding machine of this general type has been disclosed in Austrian patent No. 221,131, in which a respective grinding unit is associated with each track rail to grind irregularities off the surface areas of the rail heads of the track rails. The mounting frame for the grinding units is linked to the machine frame by tie rods, and flanged wheels support the mounting frame on the track rails. A drive is connected to the machine frame for lifting the mounting frame off the track rails. Independently of this vertical adjustment of the mounting frame, the grinding units may be vertically adjusted on the mounting frame along guides and may be pressed down by drives mounted on the machine frame so that a pressure shoe may press the abrasive band against the surface area of the rail head. The spools, which hold the opposite ends of the abrasive band, have ratchet wheels and pawls for preventing their rotation and fixing the abrasive band in position. During operation, the machine is advanced along the track while the abrasive bands of the grinding units are pressed against the surface areas of the rail heads. After a section of the abrasive band is worn out, the spools are periodically rotated while the grinding units are lifted off the rails to place a succeeding section of the abrasive band into an operating position.

U.S. Pat. No. 4,249,346 also describes a mobile rail grinding machine. Its grinding units are mounted on carrier frames having flanged wheels running on the track rails. Tie rods and a lever system link the grinding units to a crank drive mounted on the machine frame so that a reciprocating motion is imparted to the units in a direction opposite to that of the advancement of the machine along the track.

The rail grinding machine of U.S. Pat. No. 4,896,460 uses an endless abrasive band trained about vertically spaced, driven guide rollers rotating about axes extending transversely to the longitudinal direction, and the band is pressed against the surface area of the rail head to be ground. The carrier frame for the abrasive band is vertically adjustable to bring the band into its operating position.

German patent No. 3,840,006 discloses a rail grinding device comprising an endless abrasive band displaced transversely to the longitudinal direction of the rail over the surface of the rail head. The abrasive band is trained over guide rollers which may be lowered at both sides of the rail head below the surface whereby the abrasive band partially surrounds the rail head in the operative position.

SUMMARY OF THE INVENTION

It is the primary object of this invention to provide a mobile rail grinding machine of the first-described type that has an enhanced grinding capacity.

The above and other objects are accomplished by the invention in such a machine by providing means for positioning the grinding unit adjustably horizontally and in the longitudinal direction, and a driving mechanism for imparting an oscillating motion to the grinding unit, which motion is superimposed on the movement of the machine frame in the operating direction.

This arrangement produces a considerable increase in the capacity of grinding irregularities off surface areas of a rail head, compared with the grinding capacity of known units using abrasive bands, in which the operating movement of the grinding tools relative to the rail head is provided only by the movement of the machine along the track. The present grinding unit makes it possible to obtain a high-quality rail grinding with a single pass of the machine during which each surface area of the rail head is treated by the abrasive band several times by the oscillating motion of reciprocating unit. The grinding unit has the added advantage of enabling the operating capacity of the machine to be readily adapted to the prevalent conditions, it being possible, for example, simply to slow down the forward speed of the machine if the surface irregularities are severe and it is desired to increase the grinding capacity while the machine can be speeded up if the rail head surfaces are relatively smooth. Compared to grinding units with endless abrasive bands, the abrasive band used herein causes substantially fewer sparks and, therefore, diminishes the danger of track fires. Compared to grinding units with sliding whetstones, abrasive bands do not become as readily fouled. Also, whetstones are quickly deformed by protruding irregularities, which makes them useless and requires frequent replacements. The abrasive band used herein is simply reeled up on the collecting spool when it is worn, and is very economical for the grinding of highly problematic surface irregularities.

According to a preferred feature of the present invention, drive means vertically adjustably connects the flanged wheels to the mounting frame, and the drive vertically adjustably connecting the mounting frame to the machine frame is capable of exerting a downward pressure on the mounting frame. This makes it possible to adjust the grinding depth of the abrasive band simply and without problems.

According to another preferred feature, the machine further comprises a carrier frame on which the grinding unit is arranged, and the means for adjustably positioning the grinding unit comprises guide rods extending horizontally and parallel to the surface area of the rail head in the longitudinal direction, the guide rods being connected to the mounting frame and the carrier frame being displaceably mounted on the guide rods. The driving mechanism comprises a crank drive affixed to the mounting frame and a piston rod linking the carrier frame to the crank drive. This arrangement provides a very simple structure for imparting the oscillating motion to the grinding unit.

An exact positioning of the abrasive band relative to the pressure element will be obtained if guide rollers are mounted on the carrier frame for guiding the abrasive band.

A space-saving arrangement enabling the longitudinal dimension of the grinding unit to be advantageously held to a minimum is obtained if the spools are rotatable about axes extending horizontally and transversely to the longitudinal direction, are arranged vertically superposed above the pressure element and may be locked against rotation. The storage spool may have a brake and the collecting spool may have a motor for rotating the collecting spool. This enables the abrasive band to be moved over the rail head to be ground without interruption of the forward movement of the machine, particularly when the band is subject to rapid wear during a slow forward movement.

According to yet other preferred feature, the pressure element is a shoe extending in the longitudinal direction parallel to the track rails, the shoe having a surface in contact with the abrasive band and the shoe surface having a transverse profile corresponding to a desired transverse profile of the rail head surface off which the irregularities are to be ground. The shoe surface preferably extends from the surface area beyond the rounded edges to the side faces of the rail head. Furthermore, a respective double-flanged guide roller may be mounted immediately ahead and behind the pressure element in the longitudinal direction, the guide rollers being freely rotatable about axes extending transversely to the longitudinal direction and guiding the abrasive band to and from the pressure element in the longitudinal direction, the guide rollers being slightly spaced from the surface of the rail head in a vertically adjusted operating position of the grinding unit. These structures will enable the pressure shoe surface to be accurately conformed to the desired transverse profile of the rail head so that optimal operating results will be achieved with all sorts of surface irregularities encountered.

Finally, the use of two of said grinding units sequentially arranged on the mounting frame in the longitudinal direction will make it possible to achieve satisfactory grinding in a single pass of the machine even under the severest conditions.

BRIEF DESCRIPTION OF THE DRAWING

The above and other objects, advantages and features of the present invention will become more apparent from the following detailed description of a now preferred embodiment thereof, taken in conjunction with the accompanying drawing wherein FIG. 1 side elevational view of a mobile rail grinding machine according to this invention.

DETAILED DESCRIPTION OF THE PREFERRED EMBODIMENT

Figure 1:
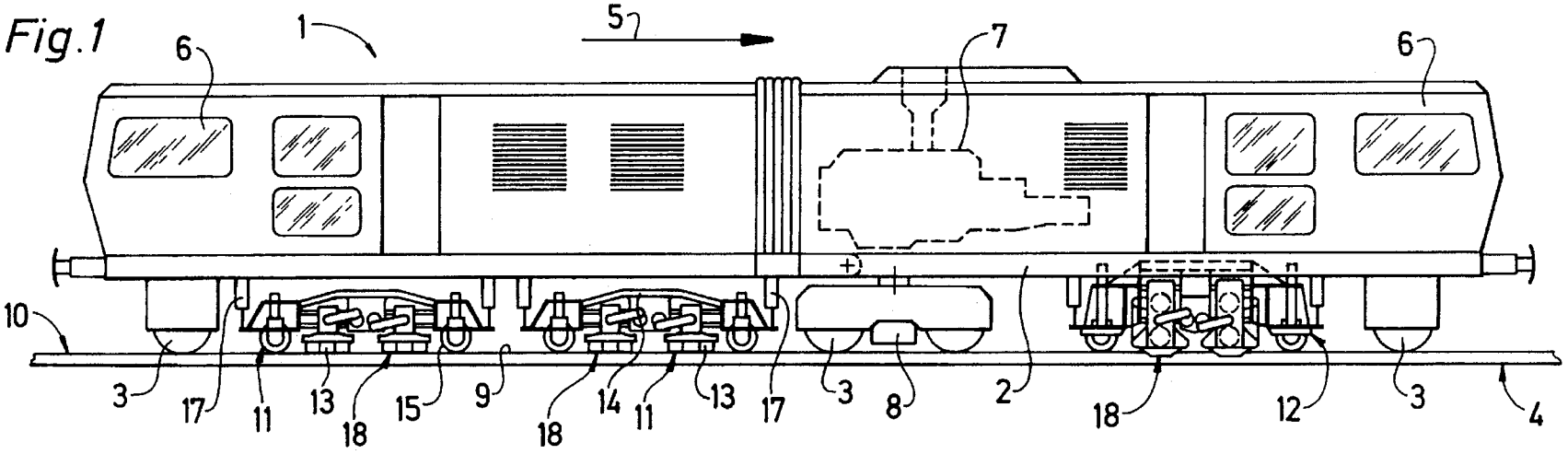

Referring now to the drawing, FIG. 1 shows mobile rail grinding machine 1 for grinding irregularities off surface area 9 of a rail head of track rails 10, the rail head having side faces 34 and rounded edges 37, 41 connecting the side faces to the surface area. The machine comprises machine frame 2 extending in a longitudinal direction, and undercarriages 3, 3 support the machine frame on track rails 10 for movement in an operating direction indicated by arrow 5. Operating cabs 6, 6 are arranged at each end of machine frame 2 which carries power plant 7 supplying energy to drive 8 of the machine and all other drives powering the operating tools of the machine.

For the purpose of grinding irregularities off surface 9 of the rail heads, machine 1 is equipped with rail grinding tools 11, 12 arranged sequentially in the operating direction along each rail 10. Two rail grinding tools 11 are mounted on the rear half of machine frame 2, as seen in the operating direction, and the illustrated grinding tools are of a conventional type, such as disclosed in U.S. Pat. No. 4,249,346, operating with whetstones 13. Since these rail grinding tools form no part of the present invention, they are not further described herein. This invention deals with rail grinding tools 12, shown in greater detail in FIG. 2, and two of these tools are mounted opposite each other in a direction extending transversely to the longitudinal direction so that the machine may be used to grind both rails 10 of track 4 at the same time.

Each rail grinding tool 12 comprises mounting frame 14 supported on track rails 10 by flanged wheels 15 at opposite ends of the elongated mounting frame which extends in the longitudinal direction above each track rail. Drives 17 at each mounting frame end vertically adjustably connect mounting frame 14 to machine frame 2. Further drives 16 vertically adjustably connect flanged wheels 15 to mounting frame 14, and drives 17 are double-acting hydraulic cylinders capable not only of lifting grinding tools 12 off track 4 but also of exerting a downward pressure on the mounting frame during the grinding operation.

At least one rail head grinding unit 18 is carried on mounting frame 14, the illustrated grinding unit comprising two grinding units sequentially arranged on the mounting frame in the longitudinal direction above each track rail 10. Each grinding unit 18 comprises abrasive belt 25 having opposite ends, a storage spool 26 holding one of the belt ends and a collecting spool 27 holding the opposite belt end whereby abrasive belt 25 may be reeled off storage spool 26 and onto collecting spool 27. Pressure element 28 is arranged to press the abrasive belt against surface area 9 of the rail head off which the irregularities are to be ground. Rail grinding unit 18 is arranged on carrier frame 19, and means for adjustably positioning the grinding unit comprises guide rods 20 extending horizontally and parallel to the surface area of the rail head in the longitudinal direction, the guide rods being connected to mounting frame 14 and carrier frame 19 being displaceably mounted on guide rods 20. Driving mechanism 21 for imparting an oscillating motion to each grinding unit 18 is mounted between the two rail grinding units, and this motion is superimposed on the movement of machine frame 2 in the operating direction. The illustrated driving mechanism comprises crank drive 22 with two crank shafts 23, which is affixed to mounting frame 14, and a respective piston rod 24 links each carrier frame 19 to a respective crank shaft of crank drive 22. As shown by small arrows in FIG. 2, this driving mechanism imparts to rail grinding units 18, 18 a reciprocating oscillating motion extending in the longitudinal direction.

Pressure element 28 is mounted at a lower end of carrier frame 19, and guide rollers 31 are mounted on the carrier frame for guiding abrasive band 25 from storage spool 26 to collecting spool 27 over the pressure element, which enables the abrasive band to be pressed against surface 9 of the rail head. The spools are rotatable about axes 29 extending horizontally and transversely to the longitudinal direction, and are arranged on carrier frame 19 vertically superposed above pressure element 28 and may be locked against rotation. To impart a pre-tension to abrasive band 25, each storage spool 26 has a brake 30. Each collecting spool 27 has a steplessly controllable motor 39 for rotating the collecting spool so that the abrasive band may be selectively reeled during a grinding operation at a slow speed.

Figure 3:
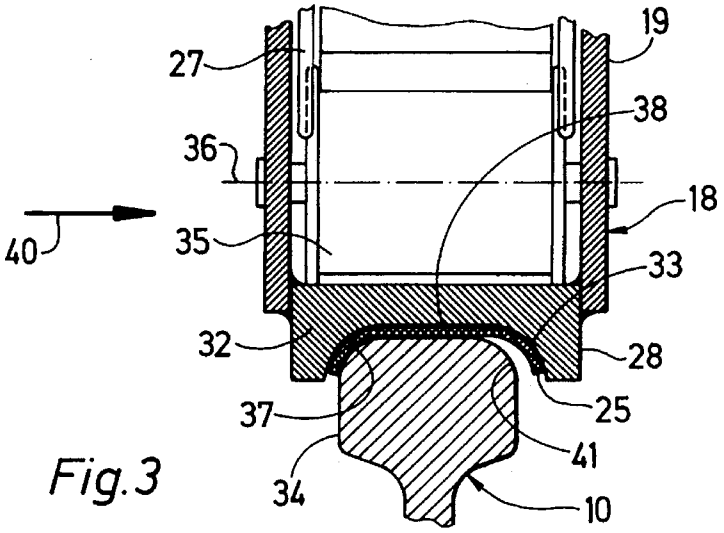
FIG. 3 is a fragmentary section along line III of FIG. 2, showing the portion of the grinding unit in contact with the rail head.

In a manner well known and not further illustrated herein, except by arrow 40 in FIG. 3, spreading drives are mounted between the oppositely arranged grinding tools 11, 12 of each pair so that whetstones 13 and abrasive band 25 of each tool will be pressed against rail head rounded edge 37 on gage side 34 of the associated rail head.

As illustrated in FIG. 3, the illustrated pressure element is a shoe 32 extending in the longitudinal direction parallel to track rails 10, and the shoe has a surface 33 in contact with abrasive band 25. Shoe surface 33 has a transverse profile 38 corresponding to a desired transverse profile of rail head surface 9 off which the irregularities are to be ground. As shown, shoe surface 33 extends from the surface area beyond rounded edges 37, 41 to the beginning of side faces 34 of the rail head. This configuration of pressure shoe 32 provides a good support for abrasive band 25 in the area of rounded edge 37 at the gage side of the rail, which is subjected to the most pronounced deformations and, therefore, requires the most intensive grinding. At rounded edge 41 at the field side of the rail, pressure shoe 32, with abrasive band 25, is spaced from rail 10.

Figure 2:
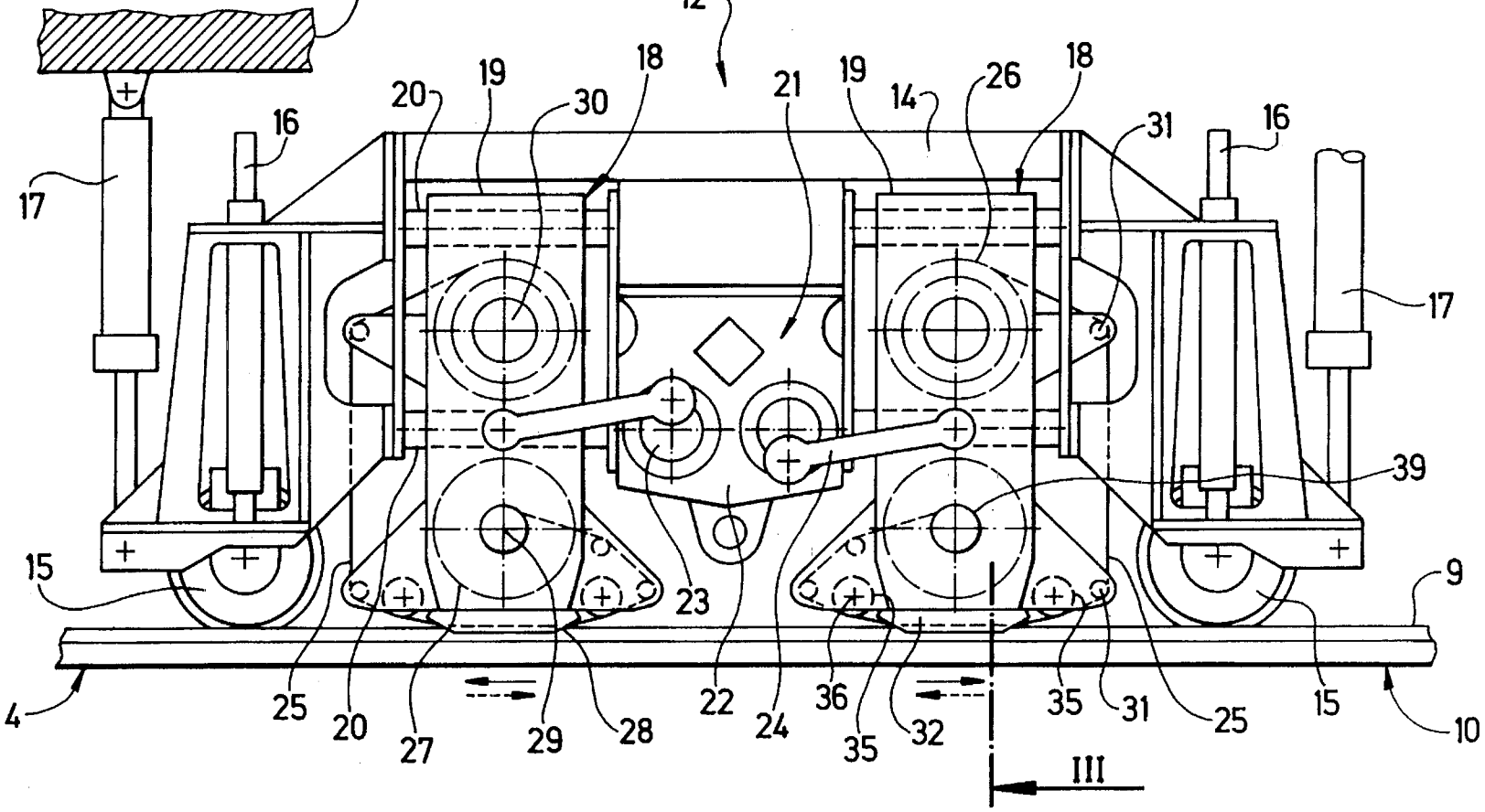
FIG. 2 in an enlarged fragmentary side elevation of the machine of FIG. 1, showing two sequentially arranged grinding units.

Furthermore, a respective double-flanged guide roller 35 is mounted immediately ahead and behind pressure element 28 in the longitudinal direction, as shown in FIG. 2. Guide rollers 35 are freely rotatable about axes 36 extending transversely to the longitudinal direction and guide abrasive band 25 to and from the pressure element in the longitudinal direction, the guide rollers being slightly spaced from surface 9 of the rail head in a vertically adjusted operating position of the grinding unit. In this way, the abrasive band will be guided precisely in a fixed lateral position relative to the pressure element.

The above-described machine operates in the following manner:

Mobile rail grinding machine 1 designed to grind irregularities off surface area 9 of the rail heads of track rails 10 is continuously moved by drive 8 along track 4 in the operating direction indicated by arrow 5 while crank drive 22 is operated to impart to abrasive bands 25 of grinding units 18 an oscillating motion extending in the longitudinal direction and superimposed on the forward motion of the machine, and drives 17 press the abrasive bands against surface areas 9 of the rail heads. The desired depth of grinding is regulated by operating drives 16 which control the vertical position of flanged wheels 15 supporting mounting frame 14 of the rail grinding units on track rails 10.

When an abrasive band 25 becomes soiled or is worn, rail grinding unit 18 is lifted off track 4 by drives 17, brake 30 is disengaged from storage spool 26 and motor 39 is operated to rotate collecting spool 27 whereby the worn section of the abrasive band is reeled onto the collecting spool and a new section of the abrasive band is engaged by pressure element 28. As mentioned before, particularly in track sections requiring intensive grinding and correspondingly involving rapid wear of abrasive bands 25, motor 39 may be operated continuously at a slow speed and brake 30 may remain released during the grinding operation to advance the abrasive band continuously.

Whenever desired, rail grinding tools 12 may be lifted into an inoperative position by drives 17. They are preferably placed into their operative position for working in track sections where the irregularities on the rail head surfaces cannot be readily ground off by whetstones 13 of rail grinding tools 11. Therefore, it is advantageous to mount rail grinding tools 12 with grinding units 18 of the present invention ahead of rail grinding tools 11 with whetstones 13, as seen in the operating direction. In this way, rail grinding tools 12 may be lifted into their inoperative position, if they are not required, and the machine may operate solely with whetstones.

What is claimed is:

1. A mobile rail grinding machine for grinding irregularities off a surface area of a rail head of track rails, the rail head having side faces and rounded edges connecting the side faces to the surface area, which comprises (a) a machine frame extending in a longitudinal direction, (b) undercarriages supporting the machine frame on the track rails for movement in an operating direction, (c) a mounting frame supported on the track rails by flanged wheels, (d) a drive vertically adjustably connecting the mounting frame to the machine frame, (e) at least one rail head grinding unit on the mounting frame, the grinding unit comprising a carrier frame carrying (1) an abrasive belt having opposite ends, (2) a storage spool holding one of the belt ends and a collecting spool holding the opposite belt end whereby the abrasive belt may be reeled off the storage spool and onto the collecting spool, and (3) a pressure element arranged between one of the spools and the abrasive belt to press the abrasive belt against the surface area of the rail head off which the irregularities are to be ground, (f) means for positioning the grinding unit adjustably horizontally and in the longitudinal direction, said means comprising guide rods extending horizontally and parallel to the surface area of the rail head in the longitudinal direction, the guide rods being connected to the mounting frame and the carrier frame being displaceably mounted on the guide rods, and (g) a driving mechanism on the mounting frame for imparting an oscillating motion to the grinding unit, which motion is superimposed on the movement of the machine frame in the operating direction.

2. The mobile rail grinding machine of claim 1, further comprising drive means vertically adjustably connecting the flanged wheels to the mounting frame, and the drive vertically adjustably connecting the mounting frame to the machine frame being capable of exerting a downward pressure on the mounting frame.

3. The mobile rail grinding machine of claim 1, wherein the driving mechanism comprises a crank drive affixed to the mounting frame and a piston rod linking the carrier frame to the crank drive.

4. The mobile rail grinding machine of claim 1, further comprising guide rollers mounted on the carrier frame for guiding the abrasive band.

5. The mobile rail grinding machine of claim 1, wherein the pressure element is a shoe extending in the longitudinal direction parallel to the track rails, the shoe having a surface in contact with the abrasive band and the shoe surface having a transverse profile corresponding to a desired transverse profile of the rail head surface off which the irregularities are to be ground.

6. The mobile rail grinding machine of claim 5, wherein the shoe surface extends from the surface area beyond the rounded edges to the side faces of the rail head.

7. The mobile rail grinding machine of claim 1, comprising two of said grinding units sequentially arranged on the mounting frame in the longitudinal direction.

8. A mobile rail grinding machine for grinding irregularities off a surface area of a rail head of track rails, the rail head having side faces and rounded edges connecting the side faces to the surface area, which comprises (a) a machine frame extending in a longitudinal direction, (b) undercarriages supporting the machine frame on the track rails for movement in an operating direction, (c) a mounting frame supported on the track rails by flanged wheels, (d) a drive vertically adjustably connecting the mounting frame to the machine frame, (e) at least one rail head grinding unit on the mounting frame, the grinding unit comprising a carrier frame carrying (1) an abrasive belt having opposite ends, (2) a storage spool holding one of the belt ends and a collecting spool holding the opposite belt end whereby the abrasive belt may be reeled off the storage spool and onto the collecting spool, the spools being rotatable about axes extending horizontally and transversely to the longitudinal direction, being arranged vertically superposed above the pressure element and may be locked against rotation, and (3) a pressure element arranged to press the abrasive belt against the surface area of the rail head off which the irregularities are to be ground, (f) means for positioning the grinding unit adjustably horizontally and in the longitudinal direction, and (g) a driving mechanism on the mounting frame for imparting an oscillating motion to the grinding unit, which motion is superimposed on the movement of the machine frame in the operating direction.

9. The mobile rail grinding machine of claim 8, further comprising a brake for the storage spool and a motor for rotating the collecting spool.

10. A mobile rail grinding machine for grinding irregularities off a surface area of a rail head of track rails, the rail head having side faces and rounded edges connecting the side faces to the surface area, which comprises (a) a machine frame extending in a longitudinal direction, (b) undercarriages supporting the machine frame on the track rails for movement in an operating direction, (c) a mounting frame supported on the track rails by flanged wheels, (d) a drive vertically adjustably connecting the mounting frame to the machine frame, (e) at least one rail head grinding unit on the mounting frame, the grinding unit comprising a carrier frame carrying (1) an abrasive belt having opposite ends, (2) a storage spool holding one of the belt ends and a collecting spool holding the opposite belt end whereby the abrasive belt may be reeled off the storage spool and onto the collecting spool, (3) a pressure element arranged between one of the spools and the abrasive belt to press the abrasive belt against the surface area of the rail head off which the irregularities are to be ground, and (4) a respective double-flanged guide roller mounted immediately ahead and behind the pressure element in the longitudinal direction, the guide rollers being freely rotatable about axes extending transversely to the longitudinal direction and guiding the abrasive band to and from the pressure element in the longitudinal direction, and the guide rollers being slightly spaced from the surface of the rail head in a vertically adjusted operating position of the grinding unit, (f) means for positioning the grinding unit adjustably horizontally and in the longitudinal direction, and (g) a driving mechanism on the mounting frame for imparting an oscillating motion to the grinding unit, which motion is superimposed on the movement of the machine frame in the operating direction.

* * * * *